United States Patent [19]

Bullock

[11] 4,196,672

[45] Apr. 8, 1980

[54] REINFORCED BOLSTER

[75] Inventor: Robert L. Bullock, Lombard, Ill.

[73] Assignee: Standard Car Truck Company, Chicago, Ill.

[21] Appl. No.: 916,760

[22] Filed: Jun. 19, 1978

Related U.S. Application Data

[63] Continuation-in-part of Ser. No. 766,022, Feb. 7, 1977, abandoned.

[51] Int. Cl.[2] ..... B61F 5/04; B61F 5/12; B61F 5/16; B61F 5/50

[52] U.S. Cl. ..... 105/230; 105/226

[58] Field of Search ..... 105/182 R, 190 R, 197 R, 105/197 D, 197 DB, 199 C, 199 CB, 206 R, 226, 227, 228, 229, 230

[56] References Cited

U.S. PATENT DOCUMENTS

| | | | |
|---|---|---|---|
| 545,792 | 9/1895 | Goltra | 105/230 |
| 1,664,224 | 3/1928 | Pinckney | 105/226 |
| 1,873,055 | 8/1932 | Sherman | 105/226 |
| 2,065,454 | 12/1936 | Hammerstrom | 105/226 |
| 2,161,513 | 6/1939 | Hammerstrom | 105/226 |
| 2,637,280 | 5/1953 | Leisk | 105/230 |
| 3,482,531 | 12/1969 | Tack | 105/226 |

*Primary Examiner*—Joseph F. Peters, Jr.
*Assistant Examiner*—Howard Beltran
*Attorney, Agent, or Firm*—Plyer, Dorn & McEachran Kinzer

[57] ABSTRACT

A railroad car truck bolster has a centrally disposed vertically arranged longitudinally extending web. The web has spaced reinforcing means with the spacing of the reinforcing means being sufficient to cause certain fractures in the web propagating along lines of maximum shear stress at approximately 45 degrees to lines of principal stress to reach a reinforcing means at a point closer to the neutral axis of the web than the next adjacent external surface of the web. The bolster side walls have openings with the above-described spaced web reinforcing means being generally in alignment with the bolster side wall openings.

6 Claims, 5 Drawing Figures

REINFORCED BOLSTER

This application is a continuation-in-part of copending application Ser. No. 766,022 filed Feb. 7, 1977 now abandoned.

SUMMARY OF THE INVENTION

The present invention relates to railroad car truck bolsters and in particular to means for reinforcing a bolster center web.

A primary purpose of the invention is a bolster having reinforcing areas along a centrally disposed web, which reinforcing areas prevent fractures in th web from propagation from one surface to the other opposite external surface.

Another purpose is a bolster of the type described in which a centrally disposed web, discontinuous at the center of the bolster, has a series of laterally extending reinforcing ribs.

Another purpose is an economical and reliable as cast strengthened bolster.

Another purpose is a bolster of the type described having spaced openings in the bolster side walls and laterally extending reinforcing ribs being generally in alignment with the side wall openings.

Other purposes will appear in the ensuring specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
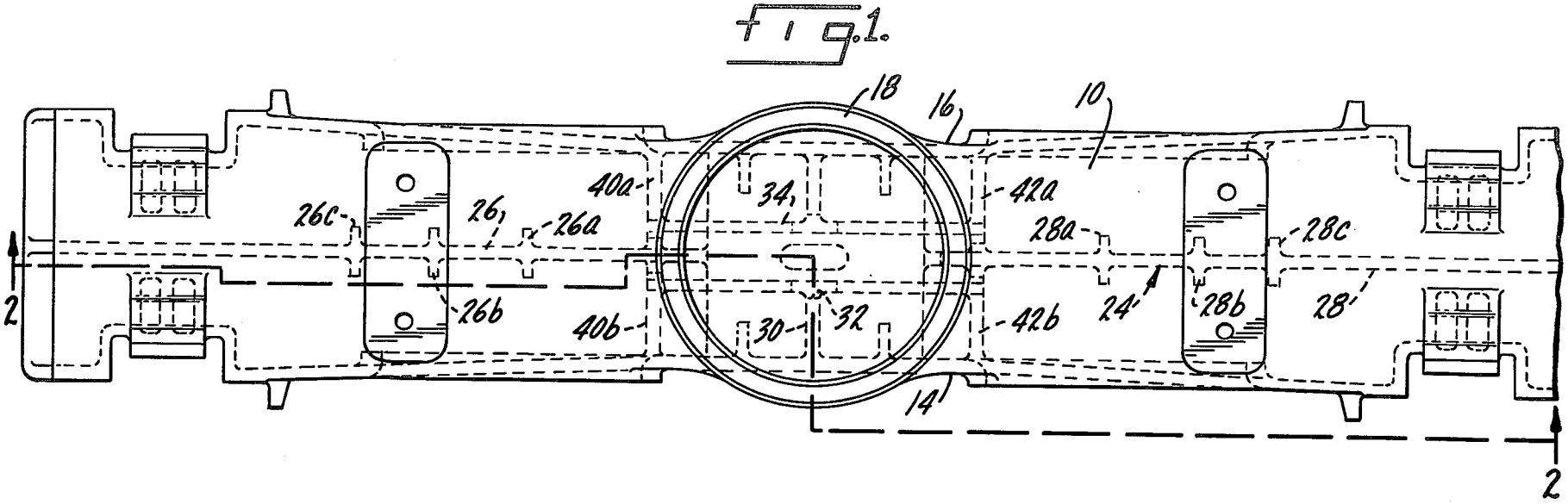
FIG. 1 is a side view, in part section, illustrating the bolster.
Figure 2:
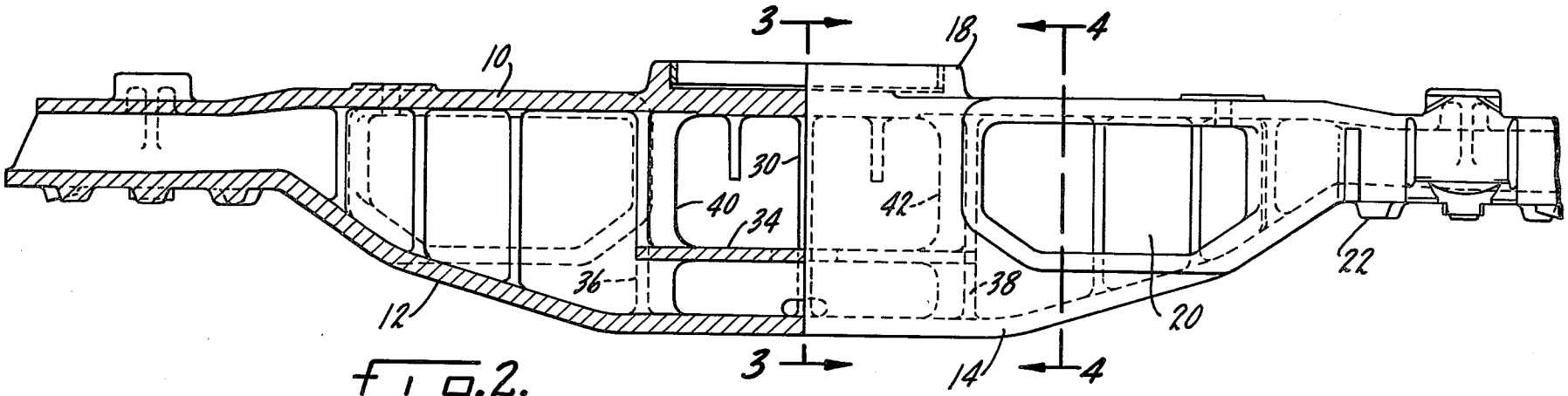
FIG. 2 is a top plan view of the bolster.
Figure 4:
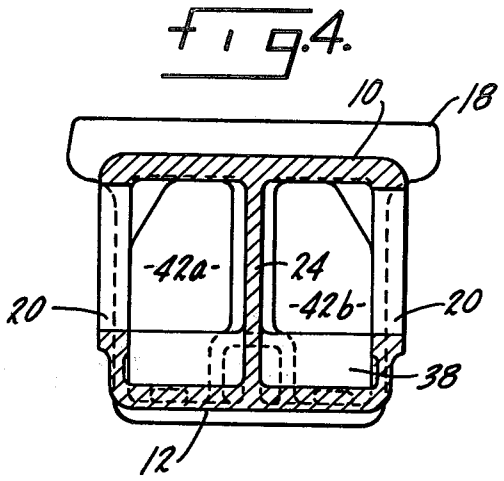
FIG. 4 is a section along plane 4—4 of FIG. 1.

Only the car truck bolster itself is shown and described herein. It will be understood by those skilled in the art that the bolster is customarily supported on springs mounted on side frames with the center hub of the bolster supporting the car body.

In the drawings, the bolster may have a top 10, a bottom 12, and side walls 14 and 16. A female center plate 18 extends upwardly from top 10 as is conventional. Side walls 14 and 16 each have a pair of spaced enlarged openings 20 which permit cross anchor rods to extend through the bolster, such rods being attached at their opposite ends, to the bearings supporting the side frames on the axles. Opposite ends of the bolster bottom 12 may have conventional spring bosses 22 which are used to position the upper end of the springs which support the bolster on the side frames.

A generally centrally disposed vertically extending web 24 extends from opposite ends of the bolster toward the center with the web being discontinuous in the area beneath female center plate 18. In effect, there are web sections 26 and 28 on opposite sides of the bolster center plate.

Figure 3:
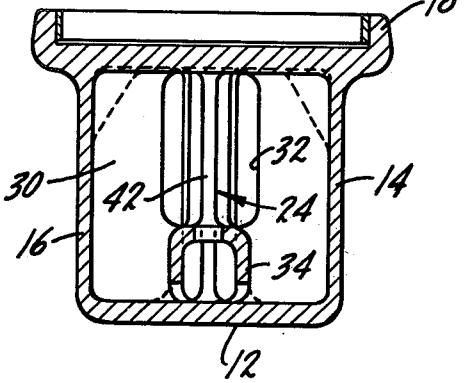
FIG. 3 is a section along plane 3—3 of FIG. 1.

In the area between web sections 26 and 28 there is a lateral center wall 30 extending between top 10 and bottom 12. There is a central opening 32 in wall 30 to permit the passage of the above-described rods. Directly below opening 32 and extending over the length of the web discontinuity is a lower box 34 shown particularly in FIG. 3. At opposite ends of the discontinuity there are internal lateral walls 36 and 38 which form the ends of box 34 and extend between top 10 and bottom 12. Each wall 36 and 38 has a centrally extending fillet, 40 and 42, respectively, with openings **40*a* and 40*b* and 42*a* and 42*b*** being on opposite sides of the fillets to permit the passage of the above-described rods.

Bolster web sections 26 and 28 each have a plurality, in this case three, laterally extending reinforcing ribs, extending from each side of the bolster web and designated as **26*a*, 26*b* and 26*c*, and 28*a*, 28*b* and 28*c*.** The reinforcing ribs or reinforcing areas or reinforcing means are specifically and particularly located as will appear hereinafter. The reinforcing means may take various forms and the ribs shown herein are only one such means.

The presence of openings 20 in the side walls of the bolster requires the addition of strengthening means. Web sections 26 and 28 provide the necessary protection. However, as a bolster is a most critical portion of the car truck and a complete fracture of the bolster web would most likely result in the complete failure of the bolster, which in turn would cause derailment of the freight car, it is necessary that the bolster webs be reinforced. The relationship between the side wall openings 20 and the laterally extending reinforcing ribs **26*a*, 26*b*, 26*c* and 28*a*, 28*b*, 28*c*** is important. The removal of metal to form the openings requires strengthening at the same locations and it is therefore important that such strengthening means be generally in alignment with the areas where the metal is removed or where the bolster has been weakened.

Structures formed of ductile metals, such as steel, which generally have equal properties in all directions, initially contain microscopic flaws. As the component is subjected to a time varying load, a typical flaw will increase in size. As the flow growth increases the strength of the component naturally decreases. As railroad freight car truck components, and more particularly the bolster, most likely will have infrequent inspections, and as there is a possibility that a flaw would not be detected during such an inspection, the bolster must be designed so that flaw growth is contained and the structure retains its required designed strength. Ribs **26*a*, 26*b*, 26*c* and 28*a*, 28*b*, 28*c*** are specifically designed to accomplish this end.

Figure 5:
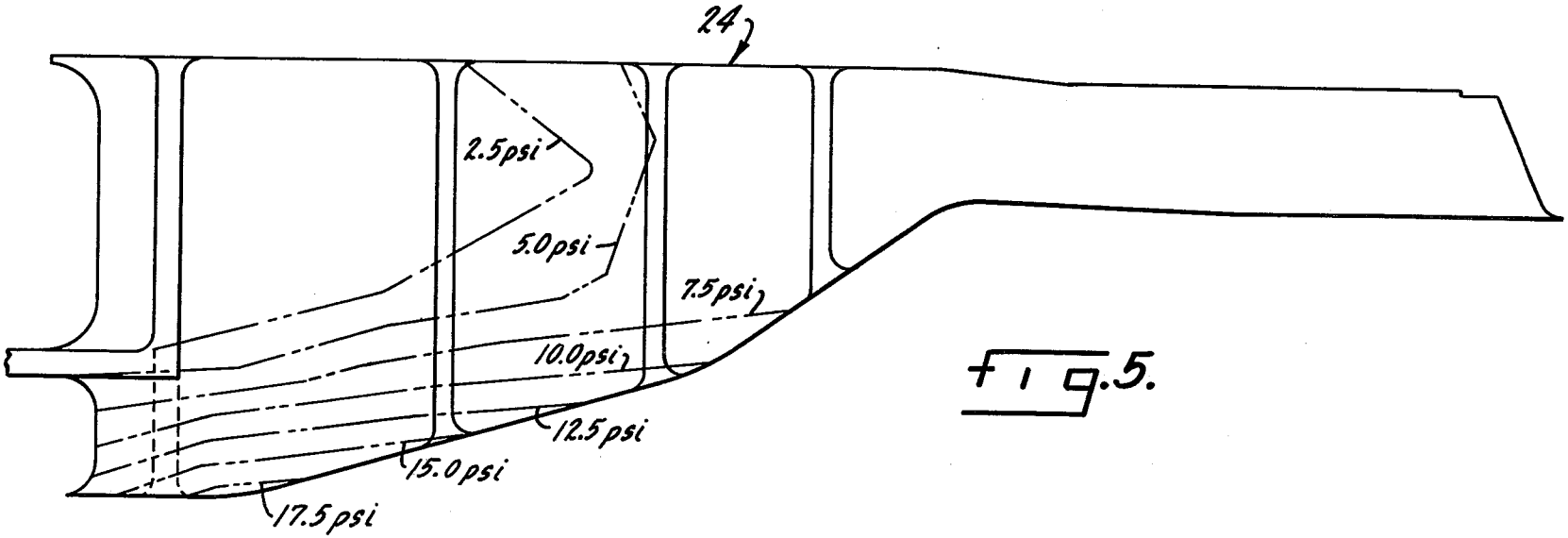
FIG. 5 is a diagrammatic illustration of the lines of principal stress applied to the bolster web under certain load conditions.

It is known that the stress most likely to lead to failure in ductile materials is shear stress. Of the many theories that have attempted to describe the mechanics of material failure, the maximum shear theory has the most practical application to the present type of structure. This theory provides that the maximum shear stress will occur on a line forming a 45 degree angle with a line of principal stress. FIG. 5 shows lines of principal stress (psi $\times$ 1,000) in web sections 26 and 28 for the particular type of load which would supply the severest test of the web component. The lines of greatest stress are at the bottom of the web with the amount of principal stress gradually decreasing toward the top of the web section. Applying the maximum shear theory, the line upon which a failure due to a microscopic flaw will propagate will be at 45 degrees to a line of principal stress. Although the lines of principal stress are not parallel, they are similar and thus in general the lines of fracture or failure propagation will be at 45 degrees or approximately so to all such lines to principal stress. The ribs or reinforcing areas 26*a*, 26*b* and 26*c*, and 28*a*, 28*b* and 28*c* are placed such that certain lines of fracture propagation will meet the reinforcing rib at a point closer to the neutral axis of the web than the next external surface, which normally would be the top surface of the web. The neutral axis is approximately at the mid-point of the web, although this will vary, depending upon construction peculiarities. Thus, it is desired that the lines of fracture from flaws near the bottom of the web, which are the flaws which will be under the greatest stress and therefore the flaws most likely to increase or propagate along the described shear stress lines, meet a reinforcing area at a point less than 75% of the full height of the web. The reinforcing means, or reinforcing areas or vertical reinforcing ribs, are effective to prevent further propagation of the described failures or fractures. Horizontal reinforcing means would not stiffen web sections 26 and 28 and thus would not be effective for the intended purpose.

As can be noted from the stress diagram, FIG. 5, the values of the lines of principal stress are substantially lower in the top area of the web than in the bottom area. Thus, fractures caused by flaws in these areas are not of substantial concern as there is normally not sufficient stress applied to that portion of the component to cause propagation of the flaw along the described fracture line. Thus, the reinforcing means are placed so as to prevent flaws in the lower portion of the web propagating along the described fracture lines from meeting an external surface, normally the top of the web. The stress applied to the lower portions of the web are those which are the highest and thus flaws in the lower portion of the web are those which must be contained.

The reinforcing ribs are spaced apart a distance so as to prevent the described flaws from propagating closer to an external surface than to the neutral axis which is generally the midpoint of the web. Although it might be an ideal solution to put many more ribs than those shown, the difficulties in casting the bolster would then become substantial. The ribs are preferably spaced apart as great a distance as possible, consistent with the described shear theory, so as to reduce the ribs to a number which can be economically and practically cored and cast. Further, as indicated above, the ribs are positioned opposite the weakened areas of the bolster, i.e. the openings 20.

Whereas the preferred form of the invention has been shown and described herein, it should be realized that there may be many modifications, substitutions and alterations thereto.

The embodiments of the invention in which an exclusive property or privilege is claimed are defined as follows:

1. In a railroad car truck bolster, a top surface, a bottom surface, and side walls, a generally centrally disposed vertical web extending between said top and bottom surface, and a plurality of generally vertically arranged spaced reinforcing means integral with said web, said top surface, bottom surface, side walls and vertical web being an integral cast structure, openings in each of said side walls on opposite sides of the bolster center line, said vertically arranged spaced reinforcing means being generally in alignment with said side wall openings, said integral reinforcing means being spaced apart a horizontal distance sufficient to block propagation of certain fractures in the web, caused by flaws in the web, along lines of maximum shear stress at approximately 45 degrees to lines of principle stress, and thereby stop further propagation thereof at a point closer to the neutral axis of the web than the next adjacent external surface of the web.

2. The bolster of claim 1 further characterized in that said reinforcing means extend outwardly from opposite sides of said web.

3. The bolster of claim 2 further characterized in that said reinforcing means extending from opposite sides of said web are in alignment.

4. The bolster of claim 1 further characterized in that said reinforcing means include laterally and vertically extending reinforcing ribs.

5. The bolster of claim 1 further characterized in that said web is positioned on each side of a generally central area of said bolster.

6. The bolster of claim 5 further characterized by and including a pair of spaced vertically extending members extending between and throughout the central area of said bolster.

* * * * *